US010084239B2

(12) United States Patent
Shaver et al.

(10) Patent No.: US 10,084,239 B2
(45) Date of Patent: Sep. 25, 2018

(54) RF DIFFRACTIVE ELEMENT WITH DYNAMICALLY WRITABLE SUB-WAVELENGTH PATTERN SPATIAL DEFINITION

(71) Applicant: Vadum, Inc., Raleigh, NC (US)

(72) Inventors: Jesse Hart Shaver, Cary, NC (US); Francois Jacques Malassenet, Raleigh, NC (US)

(73) Assignee: Vadum, Inc., Raleigh, NC (US)

( * ) Notice: Subject to any disclaimer, the term of this patent is extended or adjusted under 35 U.S.C. 154(b) by 299 days.

(21) Appl. No.: 15/070,913

(22) Filed: Mar. 15, 2016

(65) Prior Publication Data

US 2016/0276979 A1 Sep. 22, 2016

Related U.S. Application Data

(60) Provisional application No. 62/177,514, filed on Mar. 16, 2015.

(51) Int. Cl.
*H01Q 19/10* (2006.01)
*H01Q 15/14* (2006.01)

(52) U.S. Cl.
CPC ..... *H01Q 19/104* (2013.01); *H01Q 15/148* (2013.01)

(58) Field of Classification Search
CPC ..... H01Q 19/10; H01Q 19/104; H03C 7/025; H03C 3/02
See application file for complete search history.

(56) References Cited

U.S. PATENT DOCUMENTS

| | | | | |
|---|---|---|---|---|
| 5,084,707 | A | 1/1992 | Reits | |
| 5,360,973 | A | 11/1994 | Webb | |
| 6,621,459 | B2 | 9/2003 | Webb et al. | |
| 6,720,936 | B1 | 4/2004 | Koolish et al. | |
| 2008/0267231 | A1* | 10/2008 | Oktyabrsky ..... | H01S 5/18302 372/26 |
| 2012/0148252 | A1* | 6/2012 | Turchinovich ..... | B82Y 20/00 398/116 |

* cited by examiner

*Primary Examiner* — Jeffrey Shin
(74) *Attorney, Agent, or Firm* — Murphy, Bilak & Homiller, PLLC

(57) ABSTRACT

A spatial modulator for RF beams (microwave (uW), millimeter wave (MMW), and sub-millimeter wave (sub-MMW)) using dynamically-writable highly-reflective regions, with sub-wavelength diffractive pattern spatial definition that is finer than the wavelength of the incident RF beam.

19 Claims, 14 Drawing Sheets

RF DIFFRACTIVE ELEMENT WITH DYNAMICALLY WRITABLE SUB-WAVELENGTH PATTERN SPATIAL DEFINITION

RELATED APPLICATION

The present application claims the benefit of U.S. Provisional Patent Application Ser. No. 62/177,514, filed 16 Mar. 2015, the entire contents of which are incorporated herein by reference.

DEFINITION

Technical Field

The present invention relates generally to a spatial modulator. More particularly, the present invention relates to a spatial modulator for RF beams (microwave (uW), millimeter wave (MMW), and sub-millimeter wave (sub-MMW)) using dynamically-writable highly-reflective regions, with sub-wavelength diffractive pattern spatial definition that is finer than the wavelength of the incident RF beam.

BACKGROUND

Domains of Application—

Radio frequency (RF) waves in the microwave (uW), millimeter-wave (MMW) and sub-MMW (THz) bands are used in communications applications, imaging applications, and other measurement applications. Many of these applications would benefit from an efficient spatial modulator.

For imaging applications, THz beams penetrate most dielectric materials and non-polar liquids, permitting new imaging applications that are unachievable at other frequencies. THz wavelengths enable imaging capabilities with millimeter-scale resolution, as well as inexpensive and compact beam focusing. Applications of known importance include real-time low noise active imaging for covert rotorcraft navigation and landing in brownout conditions. Space applications include detection, imaging, and tracking of non-metallic debris and sun-masked objects. Due to its harmless interaction with living tissues, THz imaging provides new solutions for standoff imaging with application to non-destructive testing, as well as detection of contraband devices, illegal drugs, and explosive materials in military, homeland security, or correctional institution settings. THz frequencies are very attractive for applications where ionizing radiation is not tolerated. THz imaging can be used to detect materials hidden in clothing, and could be used to screen for shop-lifted items or other stolen goods. THz imaging can be used to view the contents of containers without opening them. THz imaging may also be useful for nondestructive noncontact subsurface inspection of structures, including composites.

For communication applications, THz beams offer very large absolute bandwidths at a region of the electromagnetic spectrum that is currently under-utilized throughout the world, and available for new communication systems. THz beams are relatively-difficult to create and modulate, owing to the high frequencies and lack of efficient active electronic devices at those frequencies. Spatial modulators would allow steering and information coding on THz beams.

Dynamic RF Diffractive Spatial Modulators—

Prior art in this area teaches spatial modulation of the RF phase front of an incoming wave using wavelength-scale zoned diffractive patterns, with reflective or absorptive regions having dimensions on the order of the RF wavelength. Prior art specifically teaches the use of Fresnel Zone Plate diffractive patterns. For example, Koolish, U.S. Pat. No. 6,720,936 B1, also teaches a derivative of the Fresnel Zone Plate, the Photon Sieve diffractive pattern. These prior-art wavelength-scale diffractive spatial modulators can be designed using only scalar diffraction theory (Kirchoff diffraction theory, Fresnel-Kirchoff diffraction theory) as typified in the well-known Fresnel Zone Plate equations.

Spatial modulation in prior art dynamic RF diffractive spatial modulators is effectively achieved through either phase modulation or amplitude modulation, where spatial regions of the Fresnel Zone Plate pattern absorb, block, or re-direct portions of the incoming beam, causing the remaining portions to have altered propagation (steered, focused, etc.). Because energy that is absorbed, blocked, or re-directed cannot be diffracted into the desired output beam, amplitude-modulating zone plates have lower diffractive efficiency compared to phase-modulating zone plates. It is also understood that spatial modulators which combine amplitude and phase modulation effects are possible.

Generation of Plasma to Create High-Loss or High-Reflectivity Regions in a Semiconductor:

Prior art discloses methods and apparatus that can be used to dynamically spatially-modulate RF beams using spatially-patterned volumes of high electronic carrier density (electron-hole plasmas). Specifically, this prior art discloses the creation of diffractive Fresnel Zone Plates (FZPs) via spatial patterning of carrier-dense plasma zones in a semiconductor. The carrier-dense plasma zones can be generated optically, with photons converted into electron-hole pairs in the semiconductor. The carrier-dense plasma zones can also be generated via direct injection of electrons via contacts, as discussed in U.S. Pat. No. 5,360,973.

Moderate carrier density increases the RF propagation loss property of the semiconductor. This RF loss can be used to absorb or block RF beams propagating through a spatial region with moderate carrier density. Very high carrier density increases the conductivity property of the semiconductor, until a "pseudometallic" state is reached. In a pseudometallic state, the semiconductor reflects incident RF beams. This reflectivity property can be used to block the RF beam in a transmission-type diffractive element, or can be used to reflect the RF beam in a reflection-type diffractive element. Webb, U.S. Pat. No. 6,621,459, teaches the use of high-intensity optical beams to generate pseudometallic carrier densities throughout the bulk of a thick semiconductor, which also serves as the phase delay layer.

Diffractive Efficiency Limits of Fresnel Zone Plates:

Prior art using wavelength-scale diffractive patterns (such as Fresnel Zone Plates and Photon Sieves) suffer from a fundamental limit on RF diffraction efficiency imposed by the coarse quantization of phase delay, which is structurally-determined by the number of physical RF phase delay layers in the modulator. The diffraction efficiency limit of such wavelength-scale Fresnel Zone Plate diffractive patterns is:

$$\frac{\sin^2(\varphi/2)}{(\varphi/2)^2}.$$

The symbol phi is the phase quantization of the modulator in degrees. For example, in the simplest structure with only two RF phase delay levels separated by 180 degrees of phase delay, the maximum diffraction efficiency of 40.5% is given by the equation [Wiltse, 2003]. In a more complex modulator with three RF phase delay levels separated by 120 degrees of phase delay (0, 120, 240 degrees), the maximum diffraction efficiency is 68.4%. For a modulator with four RF phase delay levels separated by 90 degrees (0, 90, 180, 270 degrees), the maximum diffraction efficiency is 81%. Thus, to achieve moderate diffractive efficiency with a Fresnel Zone Plate or similar wavelength-scale diffractive pattern, many phase levels are needed, which requires a more-complex physical structure with more layers. It is also noted that this simple expression only gives the diffraction efficiency limit, and other additional efficiency penalties will result from attenuation losses, shadowing effects, and surface reflection losses. This diffractive efficiency limit will apply to any diffractive element designed according to the Fresnel Zone Plate equation.

Koolish, U.S. Pat. No. 6,720,936 B1, teaches the dynamic creation of reflective and absorptive regions to generate Fresnel Zone Plate diffractive patterns and the FZP-derived Photon Sieve diffractive patterns. Both of these structures use wavelength-scale diffractive features and are limited in maximum diffractive efficiency. Koolish teaches the use of programmable reflective surfaces including electronic paper, microelectromechanical systems (MEMs), and liquid crystal displays (LCDs).

Reits, U.S. Pat. No. 5,084,707, teaches the use of thin semiconductor layers ("plates") with reflective zones formed by dense carriers patterned by laser, that are spaced with a phase delay material with a low loss coefficient and a dielectric constant nearly equal to 1.0, such as foams. These foams are fragile, and prone to mechanical or thermal damage. Foams are thermal insulators, and this insulation results in high temperature in the illuminated thin semiconductor plate. The low refractive index (dielectric constant) allows RF energy to enter and exit the foam with low surface reflection loss. However, the use of a spacer with low refractive index necessitates a physically-thicker device, and larger zone shadowing effects for off-axis RF beams. This reduces RF beamforming efficiency.

U.S. Pat. No. 5,360,973, teaches creation of Fresnel Zone Plates designed using Fresnel-Kirchhoff diffraction theory approximation. More specifically, photo-generated carrier plasmas are used to achieve MMW blocking (amplitude-modulating FZP). It also teaches the use of opposing-side electrodes that are "transparent" to MMW, but inject carriers into wafer that can be used as blocking pixels, with refresh times that are shorter than free carrier recombination times. Webb teaches the use of optically-transparent MMW back-plane reflectors using a fine metal mesh, a fine grid of conducting metal lines, or a coating such as Indium Tin Oxide (ITO). An optically transparent back-plane allows illumination from the back-side of the semiconductor.

U.S. Pat. No. 6,621,459 teaches the use of photo-carrier generation in semiconductors to achieve two modes of Fresnel Zone Plate operation, termed "improved blocking FZP" and "phase correcting FZP." The "improved blocking FZP" is a method that uses lower light intensity to create an FZP, but with a penalty in the RF output level as a result of blocking-type operation. In the "phase correcting FZP" a higher RF output level is achieved, but with a penalty of much higher light intensity requirements. This patent teaches photo-generation of pseudometallic plasma density throughout the full thickness of a semiconductor layer with thickness on the order of the RF quarter-wavelength. Because of this, a very high illumination light intensity is required to operate a phase-correcting FZP

SUMMARY

Disclosed herein are high diffractive-efficiency diffractive elements with sub-wavelength-scale patterning, for spatially modulating an incident RF beam. The RF diffractive elements use patterns of dynamically-writeable high-reflectivity regions and inter-spaced low-loss, low-surface reflectivity RF phase delay layers. These sub-wavelength RF diffractive patterns can exceed the RF diffraction efficiency limits of prior-art diffractive patterns including Fresnel Zone Plate diffractive patterns and Photon Sieve diffractive patterns using the same number of physical RF phase delay layers.

Examples of subwavelength RF diffractive patterns include spatial pulse width diffractive patterns, spatial pulse position diffractive patterns, halftone diffractive patterns, dithered diffractive patterns, metasurface diffractive patterns (split-ring resonators, U-shaped resonators, and V-shaped resonators, for example), and holographic diffractive patterns. For binary diffractive elements (with two physical RF phase delay layers), sub-wavelength diffractive patterns allow much higher diffraction efficiency, compared to 40.5% for conventional diffractive Fresnel Zone Plate designs.

Several approaches are disclosed to achieve dynamically-writable high-reflectivity plasma regions with sub-wavelength diffractive patterning at a moderate optical power level, where a plasma will be understood to be a high density region of electrons and holes. This plasma may be created by photons creating carriers in a semiconductor, and the photons may have come from a laser or other light source. Alternatively, the plasma (dense carrier region) could be directly injected through a diode junction (non-optical, no laser involved). So, a plasma type reflective region does not necessarily require a laser or light, although the detailed examples provided herein will assume the use of a short wavelength laser to generate high-reflectivity plasma regions.

The reflective region might also be a material that undergoes a metal-insulator transition as a result of heating or hot electron injection, which can be optically or non-optically driven. An example would be a vanadium dioxide layer, that can be locally heated above ~340 K to undergo a large change in conductivity and thus RF reflectivity. In summary, the change in reflectivity can be driven by a process other than injection or photogeneration of carriers in a semiconductor, and so it does not per se require a "plasma" to dynamically write a reflective region.

One aspect of several embodiments of the presently disclosed techniques is the use of short-wavelength lasers to generate dense carrier plasmas. Prior approaches use long optical wavelengths to generate carrier plasmas in semiconductors, due to reasons of lower surface reflection loss, higher quantum efficiency, and the existence of optical sources such as diode lasers with high power efficiency at these long wavelengths. In the techniques and systems described herein, shorter optical wavelengths (e.g., for silicon, wavelengths less than 600 nm, and more preferably less than 500 nm) are used. These shorter optical wavelengths can more efficiently generate dense carriers within a thin layer of a semiconductor material, such as silicon, at high rates and using moderate power. This is due to the much higher absorption coefficient of silicon at these wavelengths. The longer wavelengths used in prior art techniques are not efficiently converted to plasma within a thin semiconductor layer, due to the lower absorption coefficient in the semiconductor at these wavelengths.

Another aspect of several embodiments of the presently disclosed techniques and apparatus is the use of an optical anti-reflective structure to reduce surface reflections of the photons used to generate dense carrier plasmas in the semiconductor dynamically writeable RF reflective layer.

An optical anti-reflective structure is particularly beneficial when using shorter optical wavelengths to generate dense plasmas in silicon, due to the very high refractive index of silicon at these wavelengths. Without an optical anti-reflective structure, a large portion of the shorter-wavelength light will be reflected at the dynamically writeable RF reflective layer surface, and will not serve to generate plasma.

Still another aspect is the use of thin semiconductor layers for the dynamically writeable RF reflective layers, with thicknesses that are approximately equal to the RF skin depth in the plasma. Use of a thin semiconductor layer reduces the surface reflection losses at this layer when it is in the non-illuminated (RF-transparent) state, as the thickness may be a very small fraction of the RF wavelength in the semiconductor.

An aspect of some embodiments is the use of electrically-insulating structures to confine the dense dynamically writeable RF reflective plasmas within a thin layer. This helps preserve high plasma density against the effects of passive carrier diffusion into neighboring layers, such as RF phase delay layers. In some embodiments, electrically-insulating structures are used to laterally confine the dense dynamically writeable RF reflective plasmas. The confinement provides means to preserve the high plasma density against lateral diffusion into zones where the optical excitation is lower. This provides a means to generate high contrast between reflective or transmissive RF zones. As these lateral electrically-insulating structures reduce effective surface and volume of plasma generation, a layer of micro-lenses may be used in some embodiments, to focus the optical excitation beam to the electrically conductive zones.

In some embodiments, an active means, such as voltage biasing, is used to remove carriers from a dynamically writeable RF reflective semiconductor layer at a rate higher than the material-dependent recombination rate. Passivation of the surface of the dynamically writeable RF reflective semiconductor layer can be used to increase the carrier lifetime; silicon nitride is a good electronic passivation for silicon, and also works as a good optical-wavelength anti-reflective layer for silicon. Silicon dioxide may also be used to form a good passivation layer, and can be formed through controlled thermal oxidation of the surface. Doping of the surface of the dynamically writeable RF reflective semiconductor layer can be used to reduce the carrier lifetime; this doping may be, for example, gold or platinum doping.

In some embodiments, thermally-conductive structures may be used to remove waste heat from the dynamically writeable RF reflective layer. Some embodiments employ RF antireflection structures, which reduce impedance mismatch for RF beams entering RF phase delay layers from a medium with a differing refractive index, such as air or vacuum. Silicon is an excellent material to use as an RF phase delay layer for sub-MMW (THz) optics, as it has low loss and high refractive index. However, due to its high refractive index (n=3.4 over the 70 GHz-700 GHz range), silicon surfaces have 30% surface reflection in an air medium (n=1) if an appropriate anti-reflective structure is not used.

DETAILED DESCRIPTION

The techniques and apparatus disclosed herein provide the ability to generate high-reflectivity photoconductive surfaces with low laser power levels, using a short laser wavelength for excitation (~680×laser efficiency improvement compared to prior published designs). In some embodiments, sub-THz-wavelength binary diffractive structures, which are able to achieve very high diffractive efficiency (low insertion loss) compared to classical binary diffractive patterns (>95% versus 40.5% efficiency), are used. Aspects of some embodiments include the integration of THz antireflective (AR) structures, fast optical pattern switching methods (32 kHz to 50 MHz scan rates), silicon-on-insulator carrier confinement, and optical AR coatings. The resulting software-defined, solid-state subreflector technology can be used to outperform alternatives by orders of magnitude. The subreflector scanning speed, broad bandwidth, power efficiency, functional flexibility, ruggedness, and physical compactness will enable a wide range of leap-ahead applications.

A photoconductive diffractive device requires higher carrier densities near the surface of the semiconductor, such that it becomes highly conductive and pseudo-metallic. Previously, impractically high optical power and long carrier lifetimes were needed to operate in the pseudometallic regime, precluding high-speed low-power pseudo-metallic operation. However, this high-carrier-density region need only be created in a thin surface layer (~1 um or less), comparable to the skin depth of the RF THz wave in the plasma. Short-wavelength optical absorption coefficients in silicon are approximately two orders of magnitude greater than for longer (near-IR) optical wavelengths taught by prior art. Thus, for an equivalent incident power level, a greater carrier concentration is achieved within a thin layer of silicon. For example, at 405 nm, the absorption depth in Si is ~125 nm, while at 900 nm, the absorption depth is 33 urn, or 265× longer.

Because a thin layer comparable to the skin depth of the RF THz wave in the plasma is sufficient to achieve high reflectivity, a physically-thin dynamically writeable RF reflection layer can be used. When dense plasma is not present, this thin sheet of Si minimally affects THz wavelengths in the unexcited transparent state. Furthermore, a thin electrically insulating layer can be used to confine the dense plasma within the dynamically writeable RF reflection layer. This may be, for example a thin silicon dioxide layer.

Because the refractive index of silicon increases rapidly in the short-wavelength near-UV region (n=5.45), an appropriate optical anti-reflective coating is also quite beneficial, to reduce optical surface reflection and increase photonic efficiency. Air-to-silicon surface reflection for a 405 nm optical wavelength can be reduced from ~48% to <1% with a single-layer coating. This allows more light to enter the semiconductor to improve plasma generation efficiency.

Figure 1:
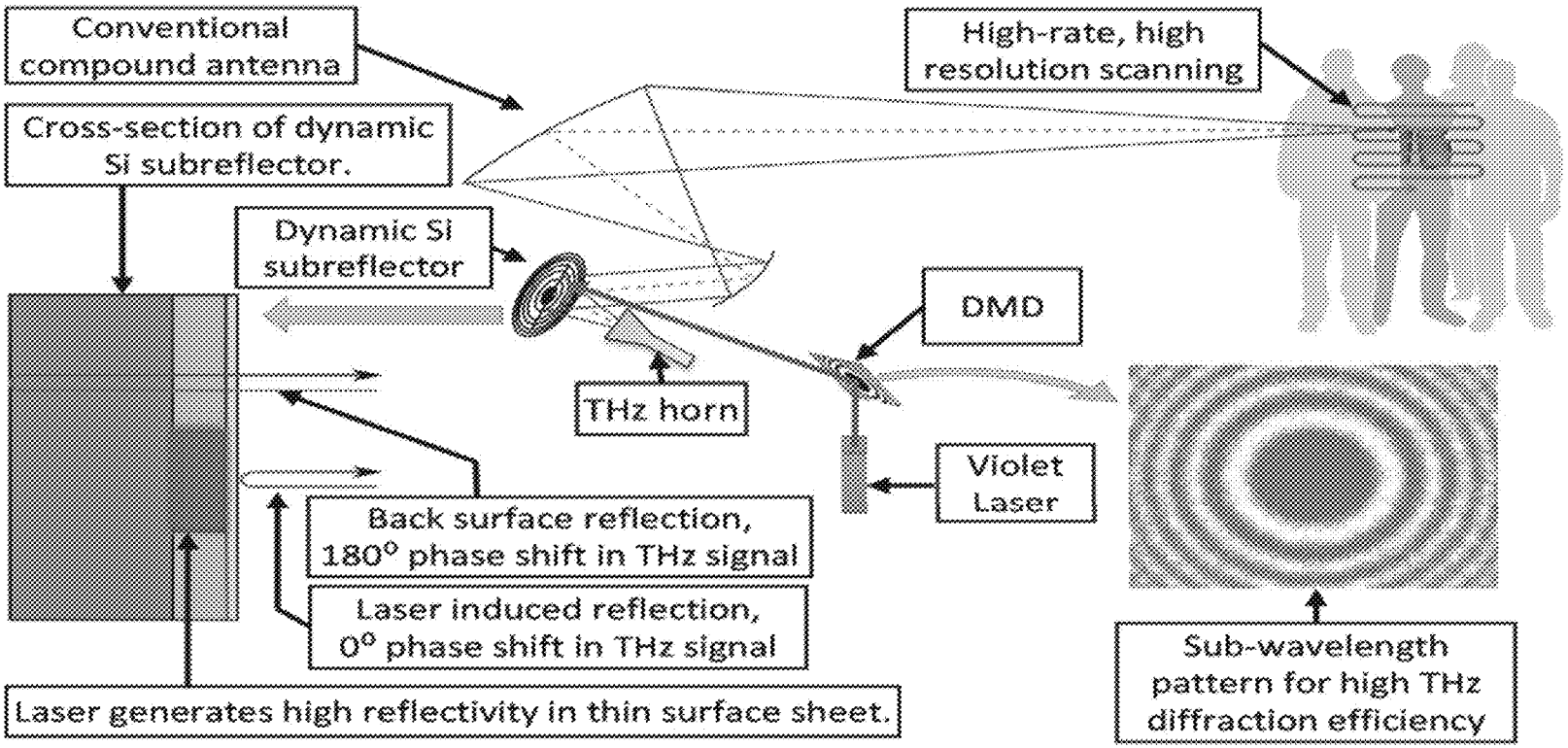
FIG. 1 illustrates an example application of the inventive techniques and apparatus disclosed herein.

FIG. 1 illustrates an example application of the described technology, for high-rate high-resolution scanning at THz frequencies. In the example system shown in FIG. 1, violet laser light (405 nm) is patterned using a digital micromirror device (DMD) to excite carriers in a thin silicon sheet on the dynamic silicon subreflector. This thin silicon sheet is thus a dynamically writeable layer, in which optically reflective regions can be patterned by the incident laser light.

A DMD, as is well known, is an optical semiconductor device that has on its surface a large array of microscopic mirrors, which in this application correspond to the pixels in the pattern to be projected onto the dynamic silicon subreflector. The mirrors can be individually rotated between an on state and an off state. In the former state, light from the laser source is reflected onto the dynamic silicon subreflector, thus illuminating the corresponding pixel in the dynamically writeable layer of the subreflector. In the off state, the light is directed elsewhere, e.g., onto a heatsink, and the corresponding pixel on the subreflector is dark.

The photoconductive regions of the dynamically writeable layer of the subreflector, when layered with an RF-phase-shifting layer and an RF-reflecting layer, form an RF zone plate. In FIG. 1, a binary phase shift is shown, i.e., where the incident RF energy can be reflected with either a 0° or 180° phase shift—in this configuration, the RF-phase-shifting layer, backed by the RF-reflecting layer, has an effective thickness equal to an odd multiple of one-quarter of the RF signal wavelength. The zone plate in FIG. 1 diffracts incident THz radiation through a compound antenna system, where the focal point of the antenna system is rapidly scanned by changing the DMD pattern. With this apparatus, the distant target can be imaged at video rates. The high DMD pixel count patterns sub-THz-wavelength diffractive features, for very high THz beamforming efficiency.

The dynamic diffractive subreflector of FIG. 1 is one example application for a high diffractive-efficiency RF diffractive elements with sub-wavelength-scale patterning, for spatially modulating an incident RF beam. The RF diffractive elements use patterns of dynamically-writeable high-reflectivity regions and inter-spaced low-loss, low-surface reflectivity RF phase delay layers. These sub-wavelength RF diffractive patterns can exceed the RF diffraction efficiency limits of prior-art diffractive patterns including Fresnel Zone Plate diffractive patterns and Photon Sieve diffractive patterns, using the same number of physical RF phase delay layers.

Examples of the subwavelength RF diffractive patterns that may be implemented using the diffractive elements and selective optical illumination techniques described herein include spatial pulse width diffractive patterns, spatial pulse position diffractive patterns, halftone diffractive patterns, dithered diffractive patterns, metasurface diffractive patterns (split-ring resonators, U-shaped resonators, and V-shaped resonators, for example), and holographic diffractive patterns. For binary diffractive elements (with two physical RF phase delay layers), sub-wavelength diffractive patterns allow much higher diffraction efficiency, compared to 40.5% for conventional diffractive Fresnel Zone Plate designs.

Several approaches are disclosed to achieve dynamically-writable high-reflectivity plasma regions with sub-wavelength diffractive patterning at a moderate optical power level. One aspect of several embodiments of the presently disclosed techniques is the use of short-wavelength lasers to generate dense carrier plasmas. Prior approaches use long optical wavelengths to generate carrier plasmas in semiconductors, due to reasons of lower surface reflection loss, higher quantum efficiency, and the existence of optical sources such as diode lasers with high power efficiency at these long wavelengths. In the techniques and systems described herein, shorter optical wavelengths (e.g., for silicon, wavelengths less than 600 nm, and more preferably less than 500 nm) are used. These shorter optical wavelengths can more efficiently generate dense carriers within a thin layer of a semiconductor material, such as silicon, at high rates and using moderate power. This is due to the much higher absorption coefficient of silicon at these wavelengths. The longer wavelengths used in prior art techniques are not efficiently converted to plasma within a thin semiconductor layer, due to the lower absorption coefficient in the semiconductor at these wavelengths.

The use of short-wavelength light (e.g., about 405 nm) provides several beneficial consequences. Short-wavelength light efficiently generates high-density carriers within a thin surface sheet volume of silicon, owing to the high absorption coefficient at this wavelength. These photoconductive sheets (on the order of the skin depth for a THz-frequency signal) are patterned to form high-reflectivity low-loss THz-diffractive structures. Fully-reflective designs are fundamentally more diffractively-efficient than absorptive photoconductive beam-steerers. Laser power is used more efficiently, since carriers are only induced in the active surface sheet volume. As detailed below, carriers in some embodiments are confined near the surface by an insulating sub-layer, which prevents diffusion into the underlying substrate. Optical anti-reflective (AR) layers at the active Si surface may also be used, to improve excitation efficiency.

Photoconductive patterning at sub-THz-wavelength lateral resolution enables greater THz diffractive beamforming and beam-steering efficiency. Advanced algorithms may be used to design high-efficiency diffractive patterns, based on phase-correcting Fresnel Zone Plates and advanced holographic and metasurface concepts. Diffractive element designs are able to exceed the often-cited 40.5% theoretical maximum diffraction efficiency for a binary diffractive element via several strategies. High lateral-patterning resolution can be used to create sub-THz-wavelength zones, which have been shown to diffract with high efficiencies, both theoretically and experimentally. The binary phase shifter)

(0°/180° is patterned over sub-wavelength dimensions to create zones with greater than two effective levels of phase quantization. Ternary)(0°/120°/240° phase shift structures are also possible, as shown in further detail below.

RF anti-reflective (AR) structures serve as impedance matching layers, such that the incident RF radiation, e.g., at THz frequencies, is able to pass into non-optically-illuminated regions of a high-index Si substrate without a high surface reflection loss (~30% for Si in air). The use of this RF AR structure can greatly increase the reflectivity range, and the diffractive efficiency.

Optical pattern rates of >1 MHz can be achieved by leveraging several complementary techniques. The incident short-wavelength light can be patterned using a Digital Micromirror Device (DMD), Grating Light Valve (GLV), or other suitable spatial modulator. DMD devices have frame rates of about 32.5 kHz, and can be combined with fast scanning techniques (electro-optic, acousto-optic) to move the optical pattern across the silicon surface at much higher effective rates (MHz to GHz). GLVs have been demonstrated with switching speeds of 20 nanoseconds, corresponding to 50 MHz switching rates.

Scanning speeds of a photo-generated diffractive subreflector are potentially limited by the rate at which optical patterns can be switched, the rate at which carriers are generated, and the rate at which carriers recombine. In prior techniques, silicon with long effective carrier lifetimes (e.g., hundreds to thousands of microseconds) was used to mitigate optical inefficiency, limiting THz beam scan rates to only a few kHz or less. Short-wavelength excitation, however, allows the use of silicon with shorter carrier lifetimes (1-30 us), compatible with high speed imaging at reasonable laser power levels.

Another aspect of several embodiments of the presently disclosed techniques and apparatus is the use of an optical anti-reflective structure to reduce surface reflections of the photons used to generate dense carrier plasmas in the semiconductor dynamically writeable RF reflective layer. An optical anti-reflective structure is particularly beneficial when using shorter optical wavelengths to generate dense plasmas in silicon, due to the very high refractive index of silicon at these wavelengths. Without an optical anti-reflective structure, a large portion of the shorter-wavelength light will be reflected at the dynamically writeable RF reflective layer surface, and will not serve to generate plasma.

Still another aspect is the use of thin semiconductor layers for the dynamically writeable RF reflective layers, with thicknesses that are approximately equal to the RF skin depth in the plasma. Use of a thin semiconductor layer reduces the surface reflection losses at this layer when it is in the non-illuminated (RF-transparent) state, as the thickness may be a very small fraction of the RF wavelength in the semiconductor.

An aspect of some embodiments is the use of electrically-insulating structures to confine the dense dynamically writeable RF reflective plasmas within a thin layer. This helps preserve high plasma density against the effects of passive carrier diffusion into neighboring layers, such as RF phase delay layers. In some embodiments, electrically-insulating structures are used to laterally confine the dense dynamically writeable RF reflective plasmas. The confinement provides means to preserve the high plasma density against lateral diffusion into zones where the optical excitation is lower. This provides a means to generate high contrast between reflective or transmissive RF zones. As these lateral electrically-insulating structures reduce effective surface and volume of plasma generation, a layer of micro-lenses may be used in some embodiments, to focus the optical excitation beam to the electrically conductive zones. The lateral insulating structures may be "negative," e.g., etched channels in the semiconductor (trenches, etc.), or "positive," such as silicon dioxide barrier layers or trenches filled with silicon dioxide.

In some embodiments, an active means, such as voltage biasing, is used to remove carriers from a dynamically writeable RF reflective semiconductor layer at a rate higher than the material-dependent recombination rate. Passivation and activation of the surface of the dynamically writeable RF reflective semiconductor layer can be used to increase or decrease the carrier lifetime.

In some embodiments, thermally-conductive structures may be used to remove waste heat from the dynamically writeable RF reflective layer. Some embodiments employ RF antireflection structures, which reduce impedance mismatch for RF beams entering RF phase delay layers from a medium with a differing refractive index, such as air or vacuum. Silicon is an excellent material to use as an RF phase delay layer for sub-MMW (THz) optics, as it has low loss and high refractive index. However, due to its high refractive index (n=3.4 over the 70 GHz-700 GHz range), silicon surfaces have 30% surface reflection in an air medium (n=1) if an appropriate anti-reflective structure is not used.

Figure 2:
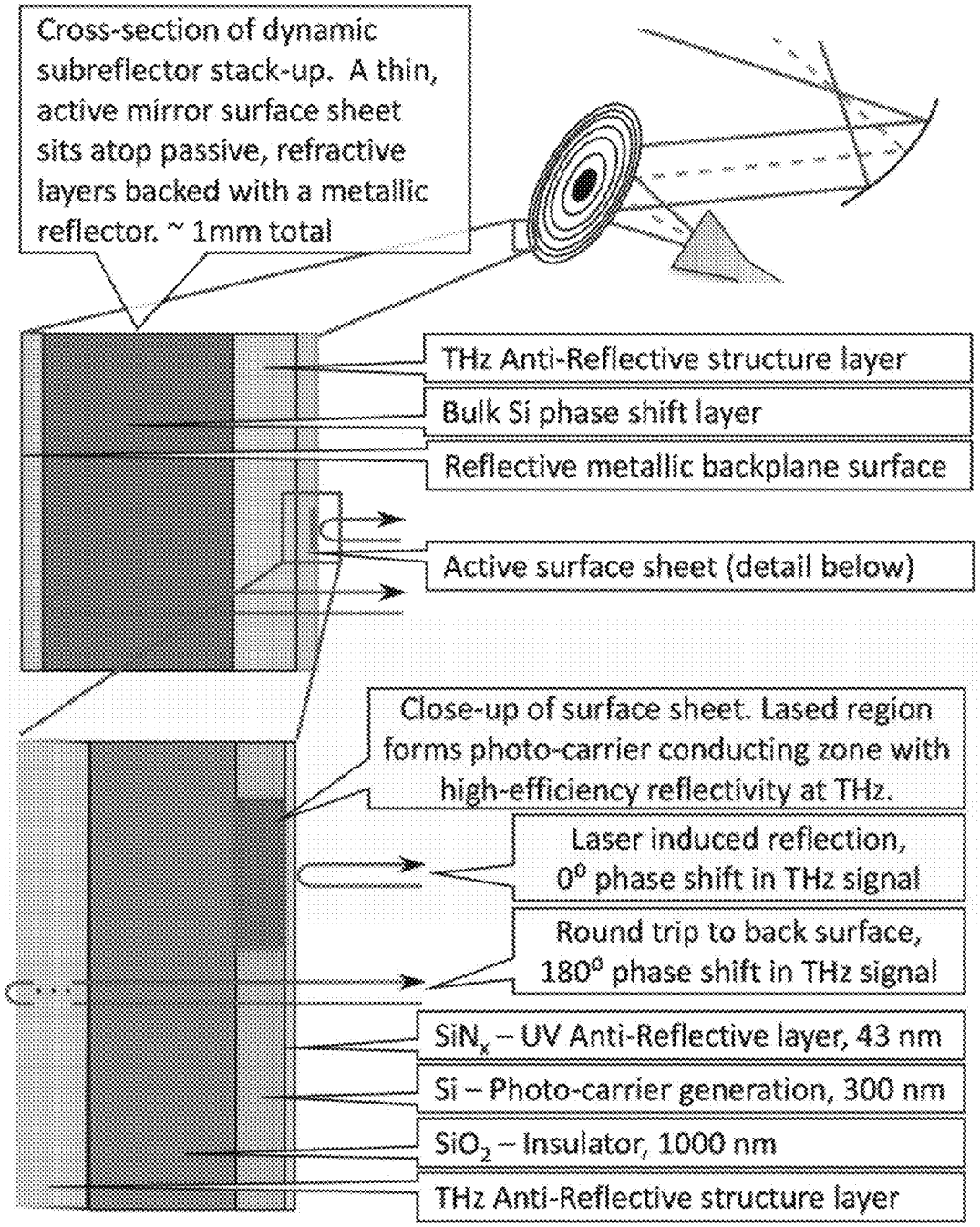
FIG. 2 shows details of an example radio-frequency (RF) diffractive element according to the presently disclosed techniques and apparatus.

FIG. 2 illustrates further details of an example diffractive element as was shown in FIG. 1. At the front surface, optical AR coatings allow efficient short-wave (e.g., 450 nm) excitation of a thin Si membrane, which is insulated from the backing substructure by a layer of silicon dioxide ($SiO_2$). An RF AR structure below the silicon dioxide layer allows incident beams at non-excited regions to enter a layer of bulk silicon, which is transparent to incident RF, and reach the backplane reflector layer. As can be seen in FIG. 2, carriers are generated by the optical illumination only in a thin surface volume, which means that dense plasma is created efficiently.

Figure 3:
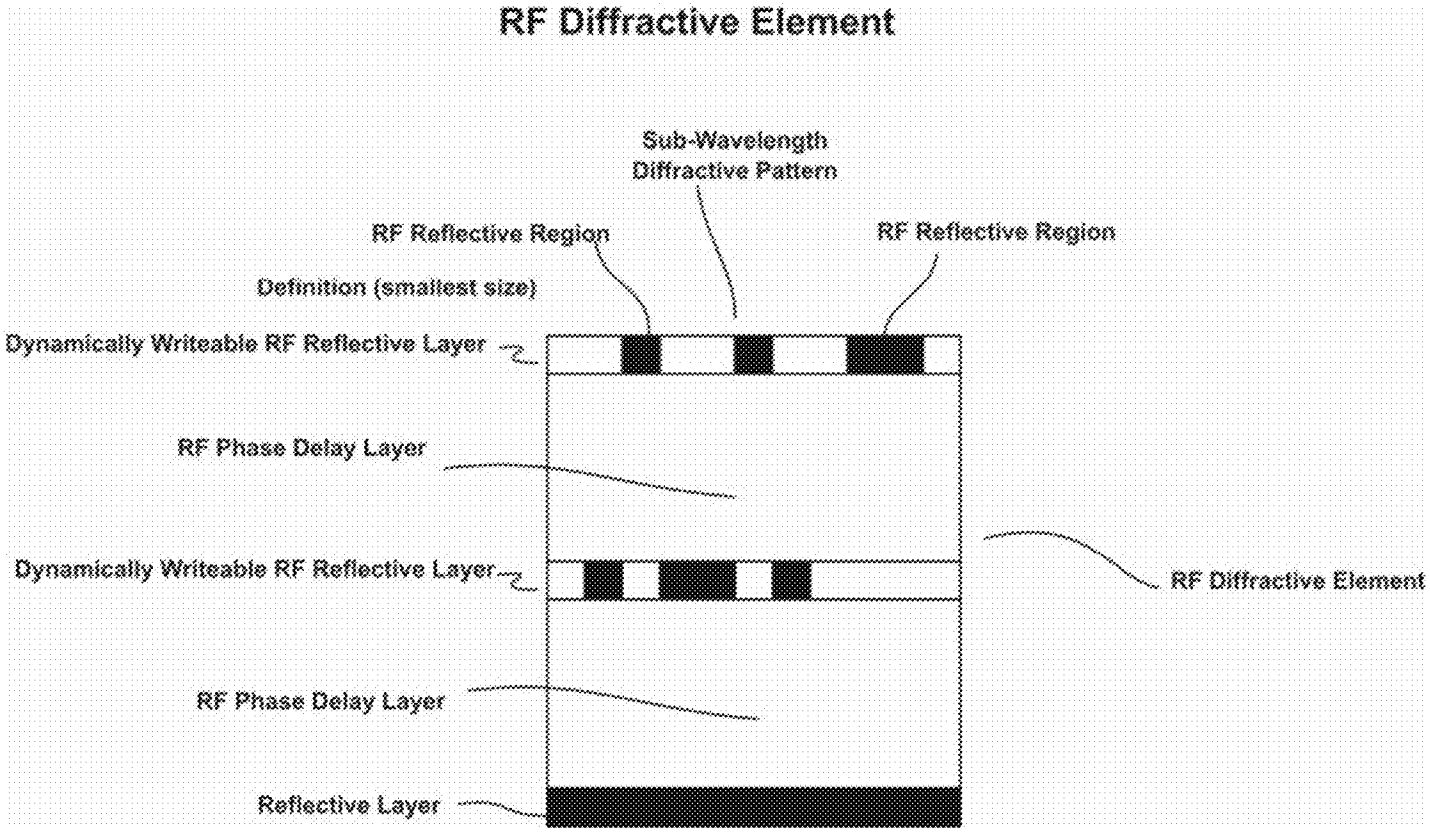
FIG. 3 is a cross-sectional view of an example RF diffractive element.

FIG. 3 is a cross-sectional view of an example RF diffractive element. The illustrated RF diffractive element is a structure consisting of several layers, in the vertical direction. In the illustrated example, there are two dynamically-writeable RF-reflective layers, two RF phase-delay layers, and an RF reflective layers. Each layer may contain one or more regions, extending in the lateral directions, of different materials. Examples of materials include RF-reflective, RF-transmissive materials, RF delay materials. RF waves incident from the environment encounter one or both of the dynamically-writeable RF-reflective layers, each of which may be patterned with RF-reflective regions arranged in a sub-wavelength diffractive pattern. These patterns reflect a portion of the incident RF wave amplitude, and transmit a portion into the below layer. The interaction of the RF wavefront with the sub-wavelength diffractive pattern diffracts the wavefront, altering its propagation. As it passes through the RF phase-delay layers, the RF wavefront phase is altered. A reflective layer back-plane (bottom) reflects any incident RF that is not reflected from higher structures. Note that this may be omitted in a transmissive diffractive element.

One approach to improve diffractive efficiency of diffractive elements having few physical RF phase delay layers is the use of sub-wavelength lateral spatial patterns to match the ideal phase shape that would be achieved with a refractive element, or an element which combines diffraction and refraction, such as a Fresnel Zone Lens (FZL). This approach has been used for diffractive lenses at optical wavelengths. In some respects, this is similar in concept to pulse-width modulation, pulse-position modulation, or half-toning used in image printing. This approach generates sub-wavelength diffractive patterns that, once spatially low-pass filtered with an impulse response of RF wavelength size, match the ideal refractive phase surface. Unlike the prior art Fresnel Zone Plates which use diffraction only, these designs diffractively mimic both the refractive and diffractive properties of Fresnel Zone Lenses (FZLs). Spatially-varying refraction is mimicked in a binary-material system (e.g., air and silicon) by applying Effective Medium Theory together with scalar diffraction theory.

Algorithmic techniques commonly used in static diffractive optical element design can be adapted to create efficient dynamically-writeable RF diffractive patterns in photogenerated carrier plasmas. Such methods include Rigorous Coupled Wave Analysis (RCWA), Finite Difference Time Domain (FDTD), and Computer Generated Holograms (CGH) techniques, which have all been used in the past to design efficient static diffractive optical elements. To adapt these methods for design of diffractive patterns formed from photogenerated carrier plasmas, the design process must also include constraints on achievable photoconductive feature definition imparted by achievable plasma RF reflectivity, finite optical pattern generation hardware capability (resolution and gridding), and carrier diffusion (lateral and axial).

Many algorithms and techniques are available to convert a continuous phase pattern into a constrained binary pattern. Efficient Gerchberg-Saxton algorithms are widely used in computer generated hologram design, but are sensitive to initial conditions and may lead to speckled beams. Constrained optimization techniques including genetic algorithms associated with finite difference time-domain (FDTD) or rigorous coupled-wave analysis (RCWA), have also been used to generate static diffractive patterns with high efficiency. For a dynamically-writeable RF diffractive element, these techniques must be extended to take into account constraints regarding the resolution and required location of the edges due to diffusion and shadowing. For dynamic RF diffractive elements using photogenerated plasmas as RF reflective regions, the sub-wavelength feature size may be limited by carrier diffusion length, which varies according to lifetime and mobility in the semiconductor. The effect of the diffusion length and minimum achievable size of the photo-induced reflective regions can be simulated in order to determine the best diffraction pattern under these constraints. A reflective sub-wavelength metasurface pattern was demonstrated for a static (non-dynamic) RF beamformer, which used a holographic reflectarray composed of sub-wavelength phase shifter elements (squares, U's, and split rings) patterned in 350 nm aluminum to form a 350 GHz beam into arbitrary patterns with up to 90% diffraction efficiency [Kuznetsov, 2015]. These patterns were designed using a Gerchberg-Saxton iterative CGH algorithm.

Figure 4:
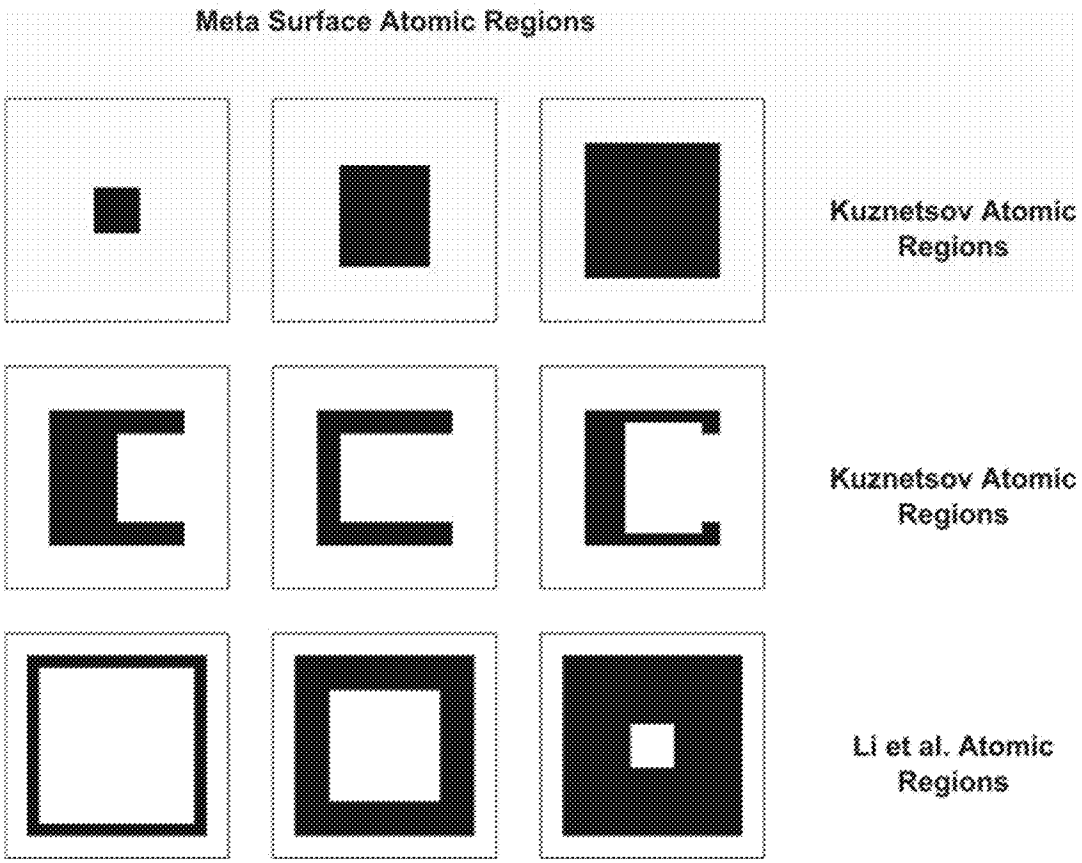
FIG. 4 illustrates meta surface atomic regions (resonator patterns).

FIG. 4 illustrates examples of meta surface atomic regions, which may be used to form sub-wavelength diffractive patterns. The sub-wavelength diffractive elements may therefore be designed as arrangements of meta-surface resonator elements, illustrated in FIG. 4 as thin conductive RF-reflective regions. In various embodiments, these may be formed from permanent conductive materials, such as thin gold or aluminum metals, or from dynamically-writable RF reflective regions, such as photo-injected carrier plasmas in a semiconductor, or locally-heated metal-insulator transition materials, or some combination. These resonator elements each impart a characteristic phase delay upon incident RF waves before re-radiation. A set of resonator elements can be used to achieve 360 degrees or more of phase delay with fine incremental control of the phase. A two-dimensional pattern formed from selected elements can be used to impart a spatially-varying phase delay upon an incident RF beam, to steer the beam to a desired direction, or focus the beam to a desired location.

Figure 5:
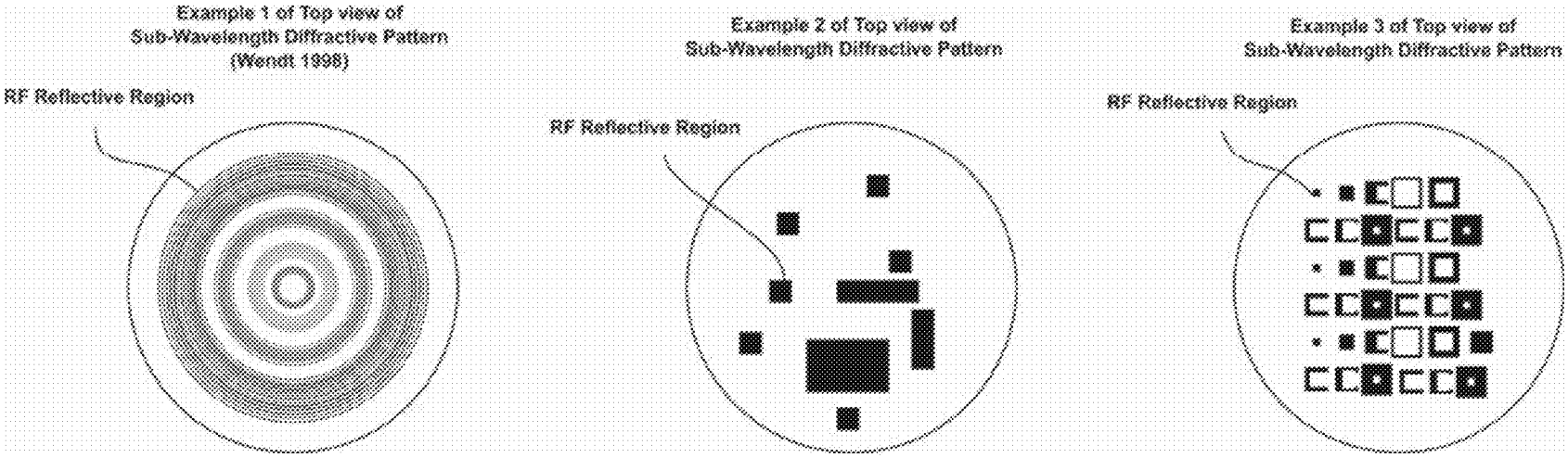
FIG. 5 shows several examples of sub-wavelength diffractive patterns.

FIG. 5 illustrates examples of sub-wavelength diffractive patterns that can be used for beam steering and beam focusing. In Example 1 of FIG. 5, the classical binary Fresnel Zone Plate diffractive pattern is mimicked with a set of spatially-fine subwavelength rings, which allow the binary structure to diffract the incident RF wavefront with greater than 1 effective bit of phase resolution. The increase in effective phase resolution is achieved by subwavelength structures which mimic a multi-level zone plate through pulse width modulation, pulse position modulation, or a combination of these effects. This allows wavelength-scale sub-regions of the pattern to achieve intermediate phase delay using only a binary structure.

Figure 6:
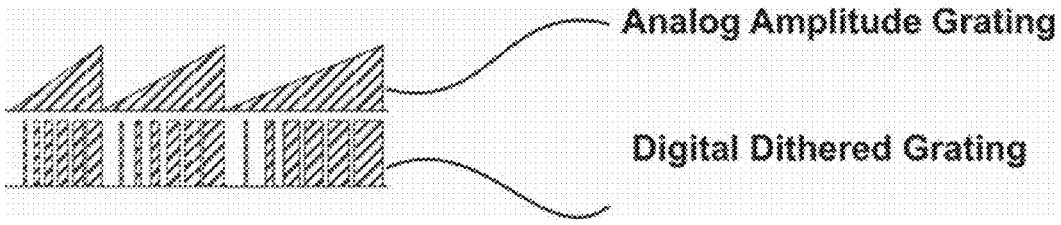
FIG. 6 shows a digital dithered grating versus a comparable analog amplitude grating.

Diffractive structures such as diffraction gratings can be created from simple stepped two-level structures, but the diffractive efficiency of these structures is limited by the coarse phase resolution. A well-known method of increasing diffractive efficiency is to create a structure which mimics a continuous analog phase modulator, such as a tilted mirror or a refractive lens, with "zones" that wrap according to modular phase. Examples of analog diffractive elements are zoned lenses or blazed gratings, which often have a sawtooth cross-section profile. A subwavelength digital dithered grating achieves effectively-greater phase resolution in a simple stepped structure by using fine subwavelength features. FIG. 6 illustrates an example of a digital dither grating structure, versus a corresponding analog amplitude grating. Locally, regions of low occupied density mimic deeper portions of the sawtooth zoned form, while regions of high occupied density mimic the raised peaks of the sawtooth zoned form.

Figure 7:
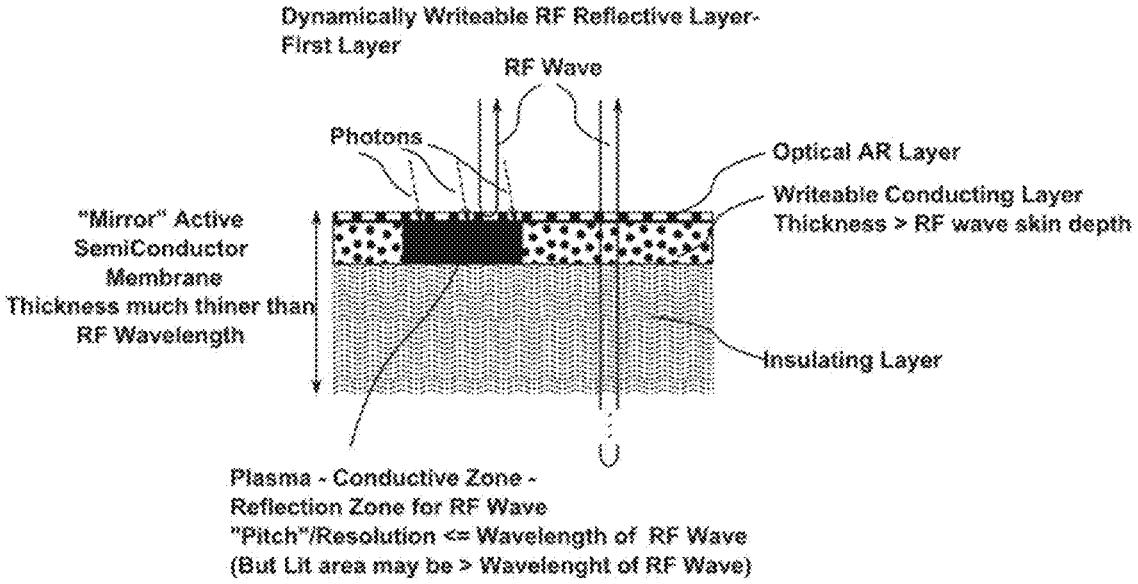
FIG. 7 illustrates details of a dynamically writeable RF-reflective layer.

FIG. 7 illustrates further details of a dynamically-writeable RF-reflective layer, according to some embodiments. The dynamically-writeable RF-reflective layer may be implemented as a thin semiconductor membrane layer with a thickness much smaller than the RF wavelength. Regions of this thin semiconductor membrane are illuminated with optical photons with energy above the semiconductor bandgap, sufficient to create electron-hole pairs in the semiconductor. If the incident optical photon flux is high enough, a dense plasma of electron-hole carriers will be created, resulting in a conductive zone which reflects or diffracts incident RF energy.

Surface reflections occur at the interface between optical media, due to refractive index mismatch. For a thick silicon layer in air, the first-surface reflection is ~30%, with $n_{si}$=3.42 at THz frequencies. In order to match the Si layer to the air medium (n=1), an antireflection layer with an intermediate index of $n_{eff}$=1.85 and a thickness ranging from 580-58 um (λ/4 of the RF wavelength in the matching layer) can be used for incident frequencies from 70 GHz to 700 GHz. In the example illustrated in FIG. 7, an optical anti-reflection (AR) Layer reduces surface reflection of the incident optical photons, allowing a higher fraction of the photons to enter the semiconductor and create carriers.

An anti-reflective (AR) structure with the correct effective index and the appropriate quarter-wave thickness can be fabricated by etching, ablating, or micromachining silicon. AR structures for impedance matching from air into silicon have been demonstrated over 70-700 GHz and beyond. Many potential strategies for reducing reflective losses at the surface of Si THz optical elements are known. By varying the volume ratio of air to Si, the effective dielectric constant can be tuned from below 2 to 11.7, forming a so-called "artificial dielectric" material. The silicon layer is etched in an aperiodic or periodic sub-wavelength pattern. Structural approaches create a transition zone of intermediate effective refractive index between the air media and Si. These include hexagonal arrays, pyramids, cones, moth-eye structures, and multi-step arrays, which may be produced on wafer-scale areas by laser micromachining, mechanical micromachining, or anisotropic etching. Si anti-reflective structures benefit from low loss, intrinsically-matched thermal expansion to the substrate, and good thermal conductivity, allowing them to handle high RF and optical power levels. Periodic hexagonal honeycomb etch patterns provide a uniform polarization-independent $n_{eff}$ variation with good performance for incidence angles up to 30 degrees [Schuster, 2005]. A filling factor of 35% yields $n_{eff}$=1.85, which is the optimal index to match air to silicon. The honeycomb provides good mechanical support and thermal sinking for a neighboring thin membrane layer.

Note that as an alternative, a material with a lower RF refractive index than silicon, such as polypropylene or Teflon AF® fluoropolymer, could be used for the RF phase delay layer. The choice of RF phase delay layer is influenced by other performance factors, such as RF loss coefficient, thermal conductivity, and thermal expansion coefficient.

An electrical insulating layer beneath the semiconductor membrane prevents carriers from diffusing into deeper material, such as a semiconductor delay layer. An example of an electrical insulating layer is also illustrated in FIG. 7, where the electrical insulating layer is arranged beneath the writeable conducting layer and the semiconductor phase delay layer (not shown in FIG. 7). This insulating layer may be formed, for example, from silicon dioxide, using conventional semiconductor device fabrication techniques.

Figure 8:
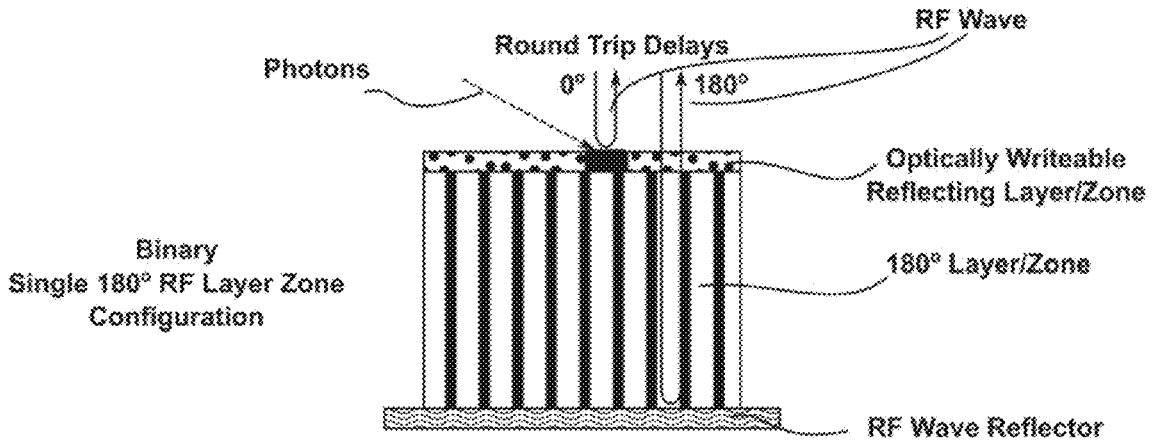
FIG. 8 illustrates a binary, single-180°-RF-layer configuration.

The RF diffractive structure can be implemented with one or several dynamically writeable RF reflective layers. In the single-layer binary version, an example of which is shown in FIG. 8, an optically writeable reflecting layer is separated from a RF wave reflector backplane by an RF phase delay layer that gives 180 degrees of round-trip phase delay. The backplane may be a metallic layer, in some embodiments, and may be optically transparent in some cases. Photons incident from the front create RF-reflective plasma regions, which reflect and diffract incident RF waves.

Figure 9:
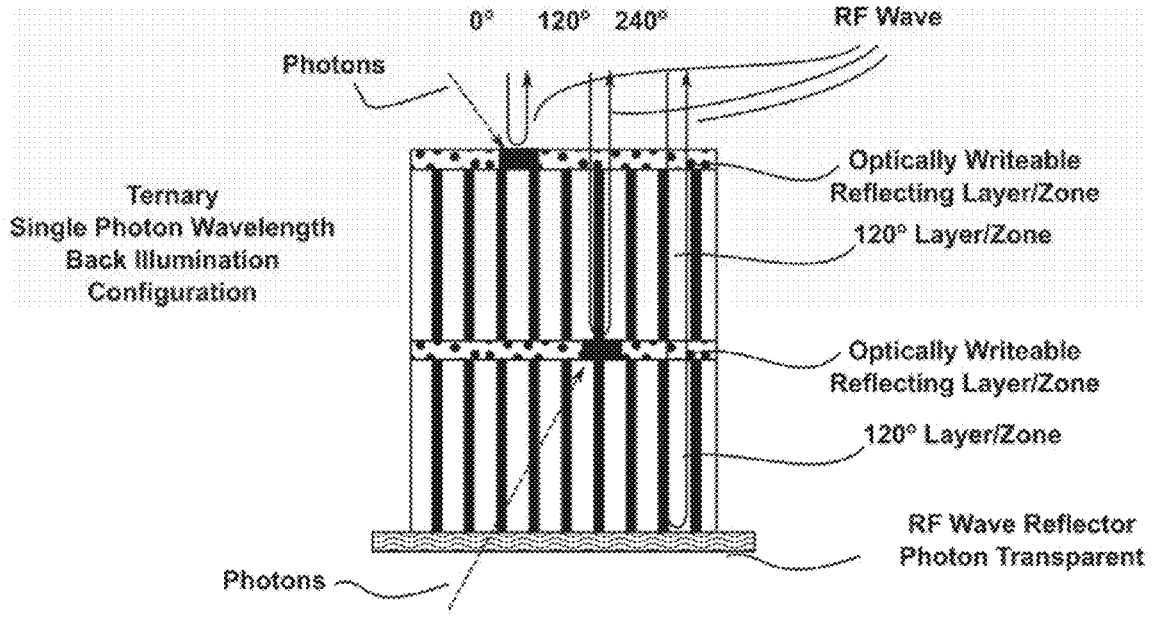
FIG. 9 shows a ternary single photon-wavelength back-illumination configuration.

FIG. 9 illustrates an example of a multi-layer ternary version, in which the RF Wave Reflector backplane is transparent to photons but reflective to RF, and is made from a transparent conductor such as Indium Tin Oxide (ITO). This allows patterned photons to be introduced from both the front and back directions, creating RF-reflective plasma layers in two optically-writable layers. The RF phase delay layers have a thickness that gives 120 degrees of round-trip phase delay per layer.

For a RF spatial modulator, it is desirable to have high modulation depth, or a large difference in surface reflectivity between active and inactive regions of the dynamically-writeable RF reflection layer(s). High reflectivity in an active region is achieved by implementing features which enable the creation of dense, highly-conductive pseudometallic plasmas within the dynamically-writeable RF reflection layer(s). Low reflectivity in an inactive region may be achieved through a combination of features, including a very thin dynamically-writeable RF reflection layer, and the use of RF antireflection structures to match the refractive index of the surrounding medium (air, vacuum, etc.) to the refractive index of the RF phase delay layer medium.

Figure 10:
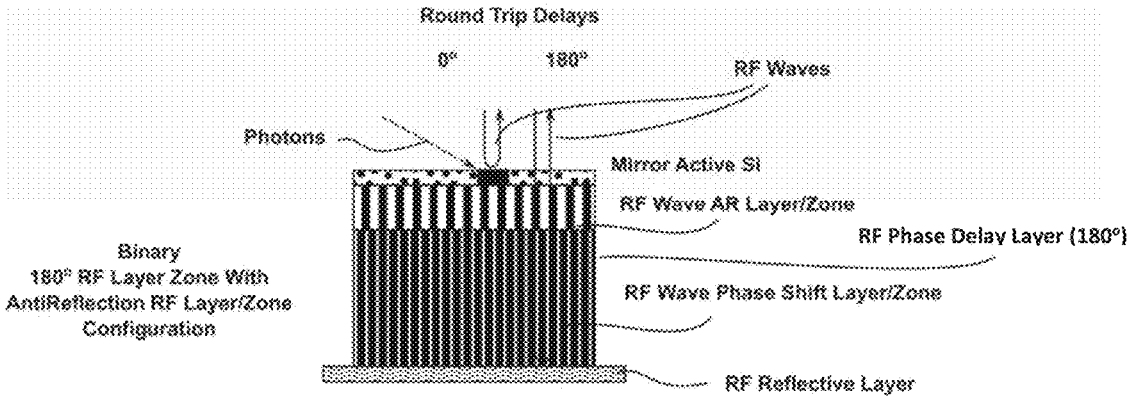
FIG. 10 illustrates a binary 180°-RF-layer configuration with an anti-reflection RF layer.

Certain materials which are well-suited for use as rugged low-loss RF phase-delay layers have high refractive indices at RF frequencies. For example, high-resistivity silicon has low loss at millimeter wavelengths, but the refractive index of silicon at these RF frequencies is approximately 3.42. RF waves incident from air (with an RF refractive index of approximately 1.0) will undergo a large Fresnel surface reflection of approximately 30%, owing to the large difference between the index of air and silicon. Therefore, the depth of modulation of the RF wave reflectivity will only span from 30% (low) to 100% (high). As shown in the example illustrated in FIG. 10, an RF wave anti-reflection layer can be added to reduce the RF reflectivity of the front surface in the un-illuminated state, and therefore increase the depth of RF reflectivity modulation from nearly 0% (low) to 100% (high).

Figure 11:
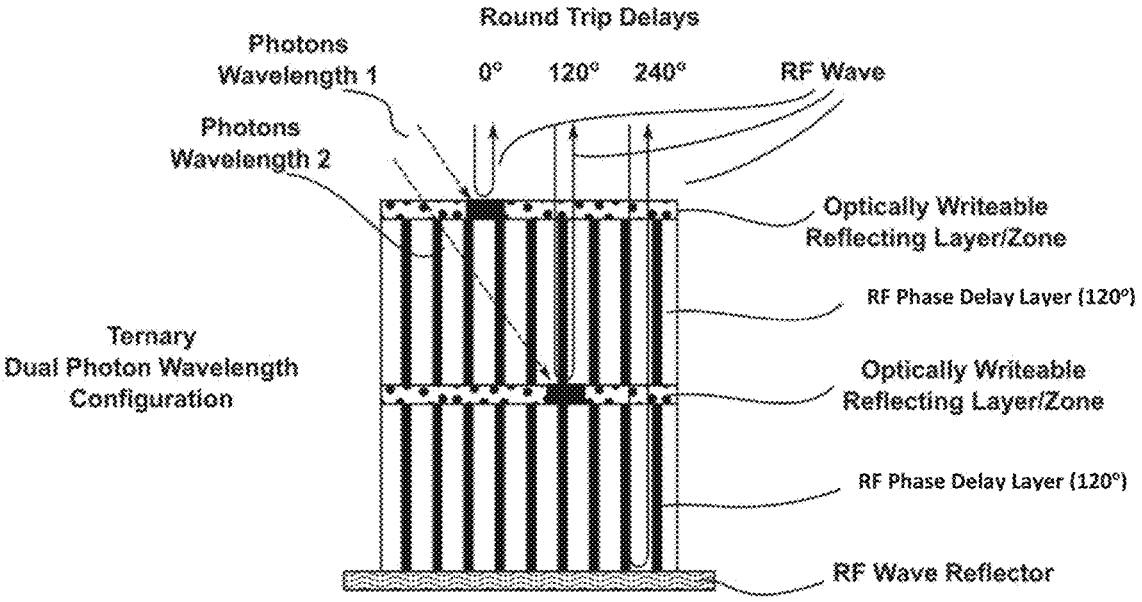
FIG. 11 shows a ternary dual photon-wavelength configuration.
Figure 12:
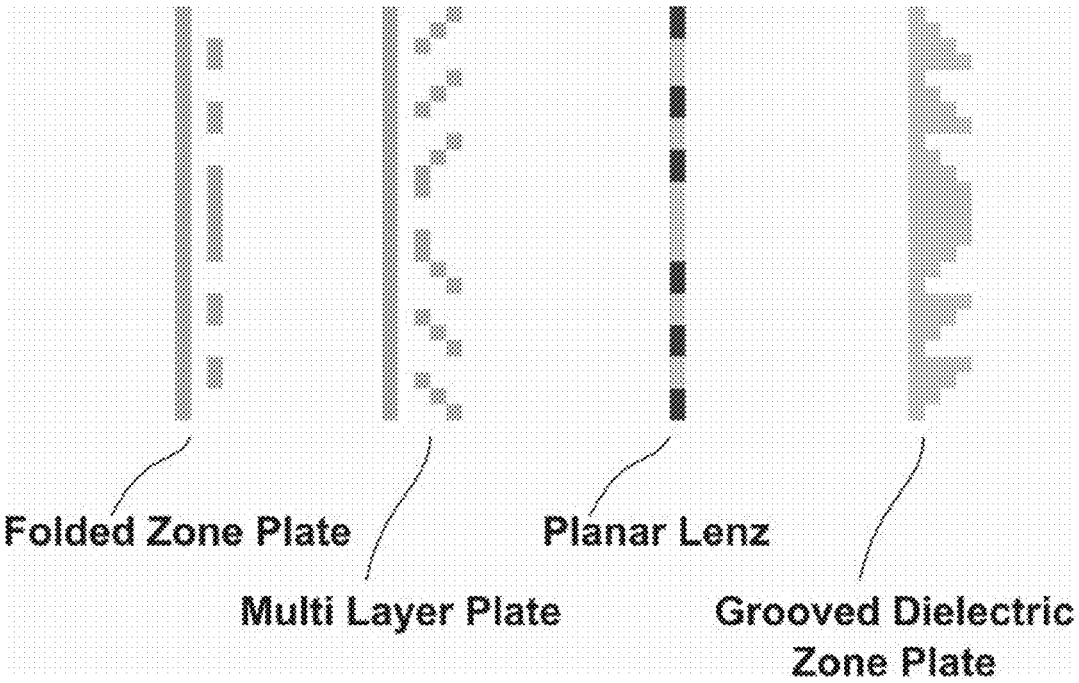
FIG. 12 illustrates examples of phase-correcting zone plates.

FIG. 11 illustrates an example of a dual photon-wavelength ternary implementation variant, where two different photon wavelengths are used to excite carriers in two respective optically writeable layers. Photons at a first wavelength (wavelength 1) are efficiently absorbed and converted to carriers in the first optically writeable reflecting layer, while photons at a second wavelength (wavelength 2) are able to pass through this semiconductor, being absorbed in the second semiconductor layer, which may be formed from a different material with a different semiconductor band gap energy. Because both photon wavelengths are incident from the front direction, the RF wave reflector in this embodiment need not be constructed from an optically transparent material, and may be constructed from a conventional opaque metal.

Figure 13:
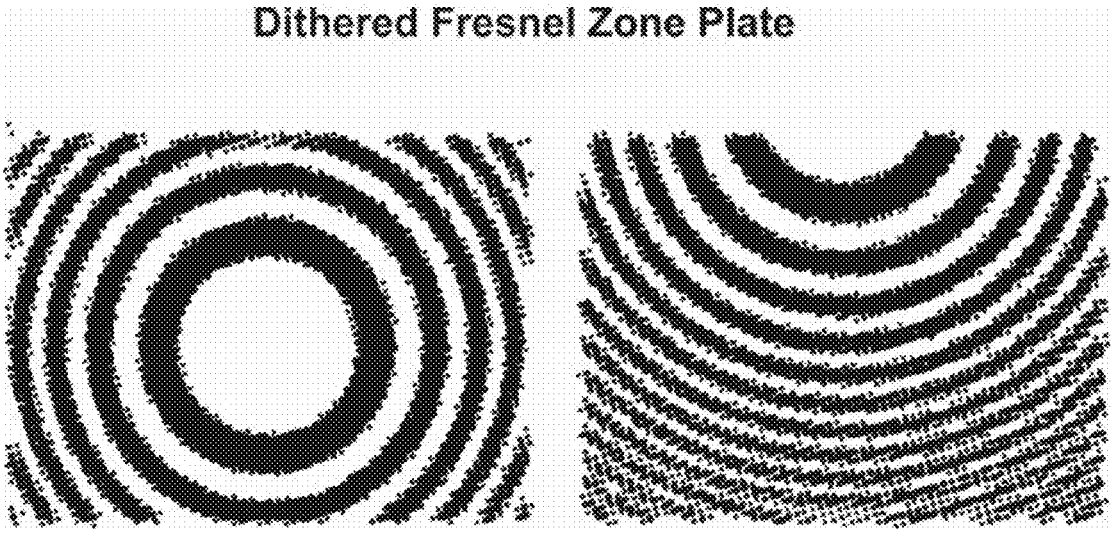
FIG. 13 shows examples of a dithered Fresnel zone plate.

Using the RF diffractive elements detailed above, improved diffractive efficiency can be achieved through dithering of a diffractive pattern. In this case, subwavelength dots are used to approximate intermediate levels of phase delay, approximating a zoned lens surface rather than a simple zone plate. FIG. 13 shows portions of example dithered Fresnel zone plate patterns.

Figure 14:
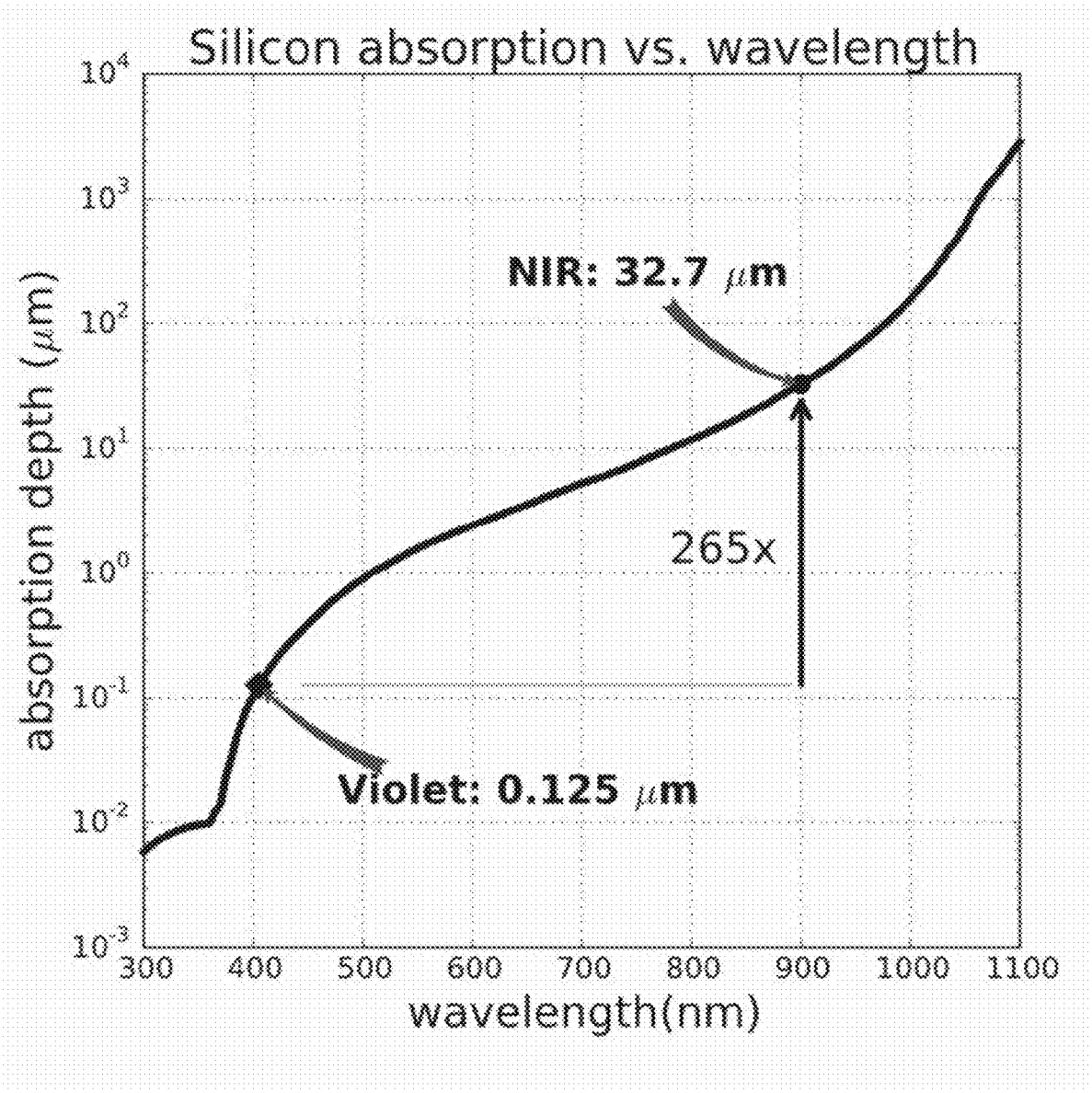
FIG. 14 illustrates silicon absorption versus optical wavelength.

As noted above, embodiments of the presently disclosed RF diffractive elements may be formed from silicon. The absorption depth of silicon varies over several orders of magnitude as a function of wavelength. As shown in FIG. 14, blue (~450 nm) or violet (~400 nm) wavelengths are absorbed in a very shallow surface layer of silicon. Because of this, a very dense plasma layer can be created in a thin layer of semiconductor using blue or violet wavelengths. Thin semiconductor layers (<30 micrometers) can be patterned and etched at full thickness more easily than deep semiconductor layers (>30 micrometers) using low aspect ratio processes.

Figure 15:
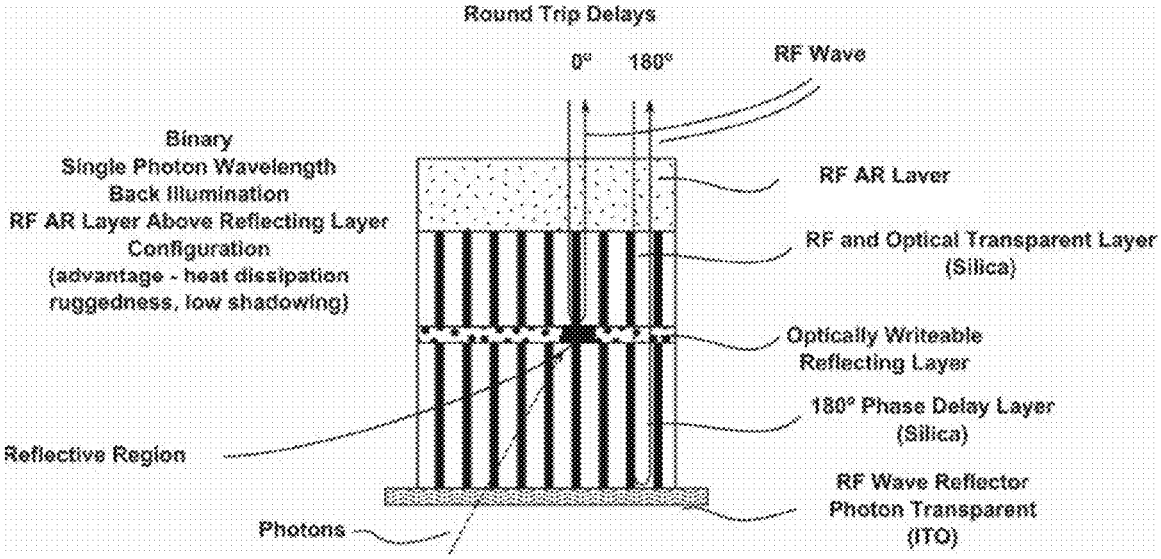
FIG. 15 shows a binary single-photon-wavelength back-illumination configuration with an RF anti-reflective layer above the reflecting layer.

It will be appreciated that variations of the configurations described above are possible. FIG. 15, for example, illustrates an example of a binary, single-photon-wavelength diffractive element, where the optical illumination of the rewritable reflection layer is from the back side, through an optically transparent RF wave reflector layer.

Figure 16:
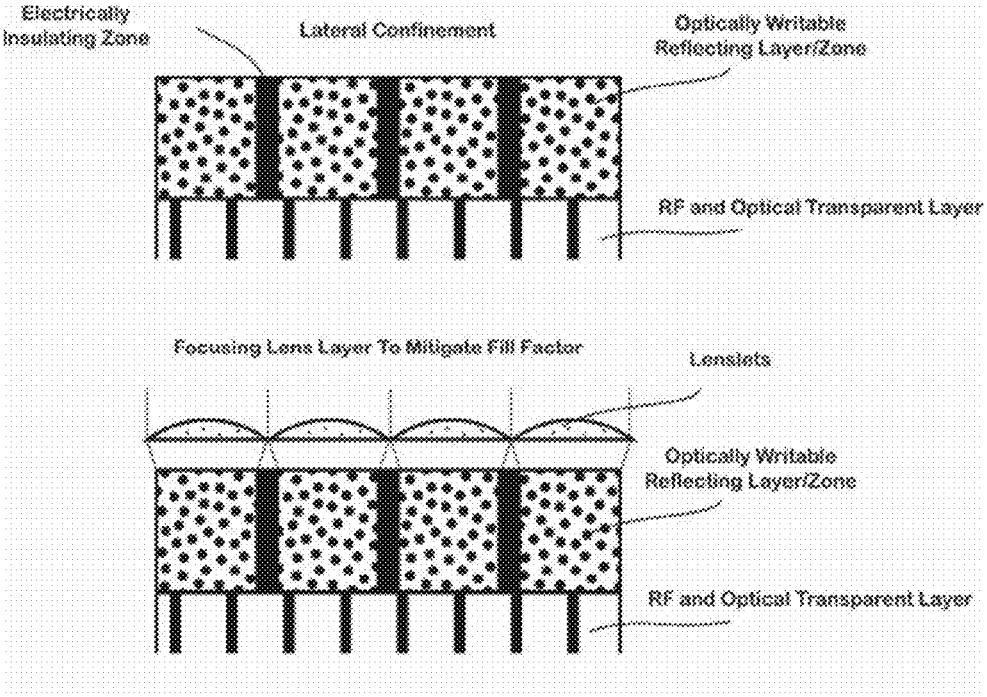
FIG. 16 illustrates the use of lateral confinement structures.

In the example embodiments shown in FIG. 16, electrically insulating structures are added in the optically writeable layer, to confine carriers against lateral diffusion within the thin optically writeable reflecting semiconductor layer. It will be appreciated that the addition of these electrically insulating structures reduces the active area of the optically-writeable reflective layer, wasting photons which strike the insulating structures. To reduce this waste, an array of lenslets may be added to focus incident optical photons onto the remaining semiconductor regions, as shown in the bottom portion of FIG. 16.

Figure 17:
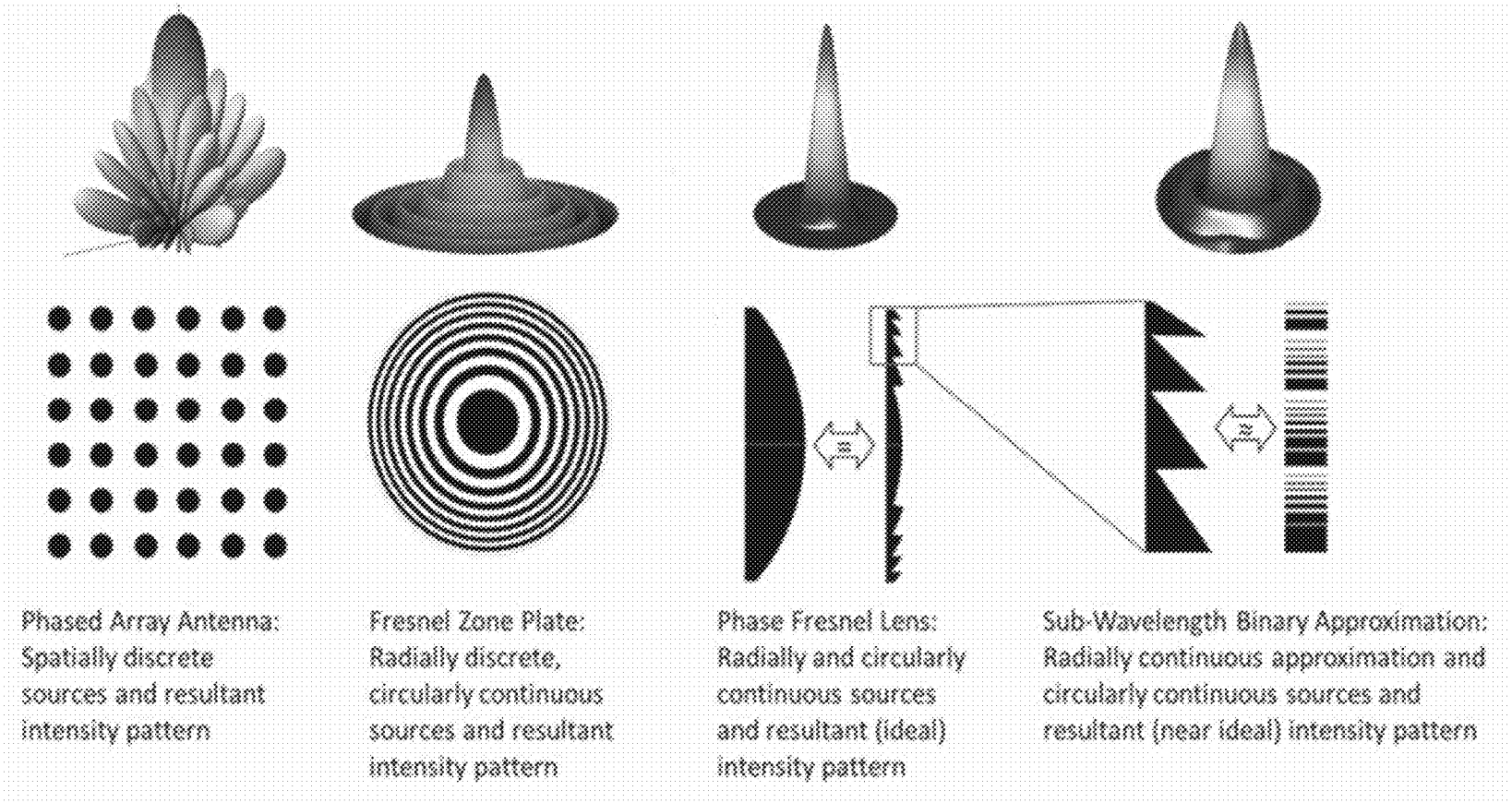
FIG. 17 illustrates typical beam patterns for standard diffractive structures, versus an example beam pattern for a diffractive element formed according to the presently disclosed techniques.

FIG. 17 illustrates typical beam patterns for standard diffractive structures. A phased array produces many sidelobes. A binary Fresnel zone plate produces a circularly-symmetric beam and sidelobes. A Fresnel lens collapses the ideal refractive lens into a flat structure, and produces a high-quality main lobe. The sub-wavelength features of a binary diffractor, realized using the techniques disclosed herein, can approximate the continuous phase delay of a lens, as shown at the right-hand side of FIG. 17, producing nearly the same beam pattern as the lens.

Figure 18:
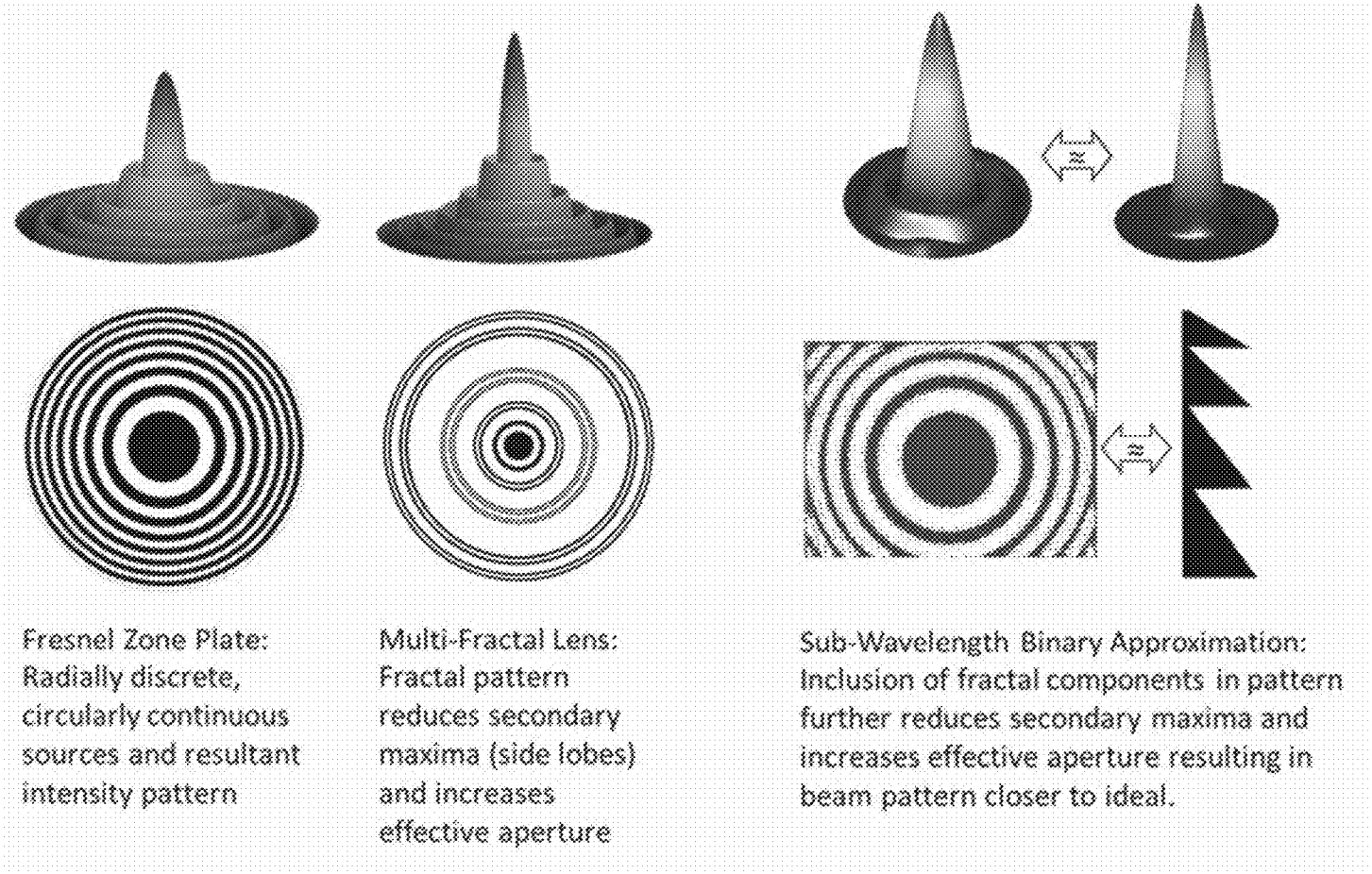
FIG. 18 illustrates the use of multi-fractal diffractive structures and half-toning at sub-wavelength scales, to achieve narrower beams with altered sidelobes.

FIG. 18 illustrates how, compared to the standard Fresnel zone plate on the left, multi-fractal Zone plates formed according to the techniques described herein can achieve narrower central beams with altered sidelobes. Half-toning at subwavelength scales allows a binary diffractive structure to approximate a continuous-phase lens.

Figure 19:
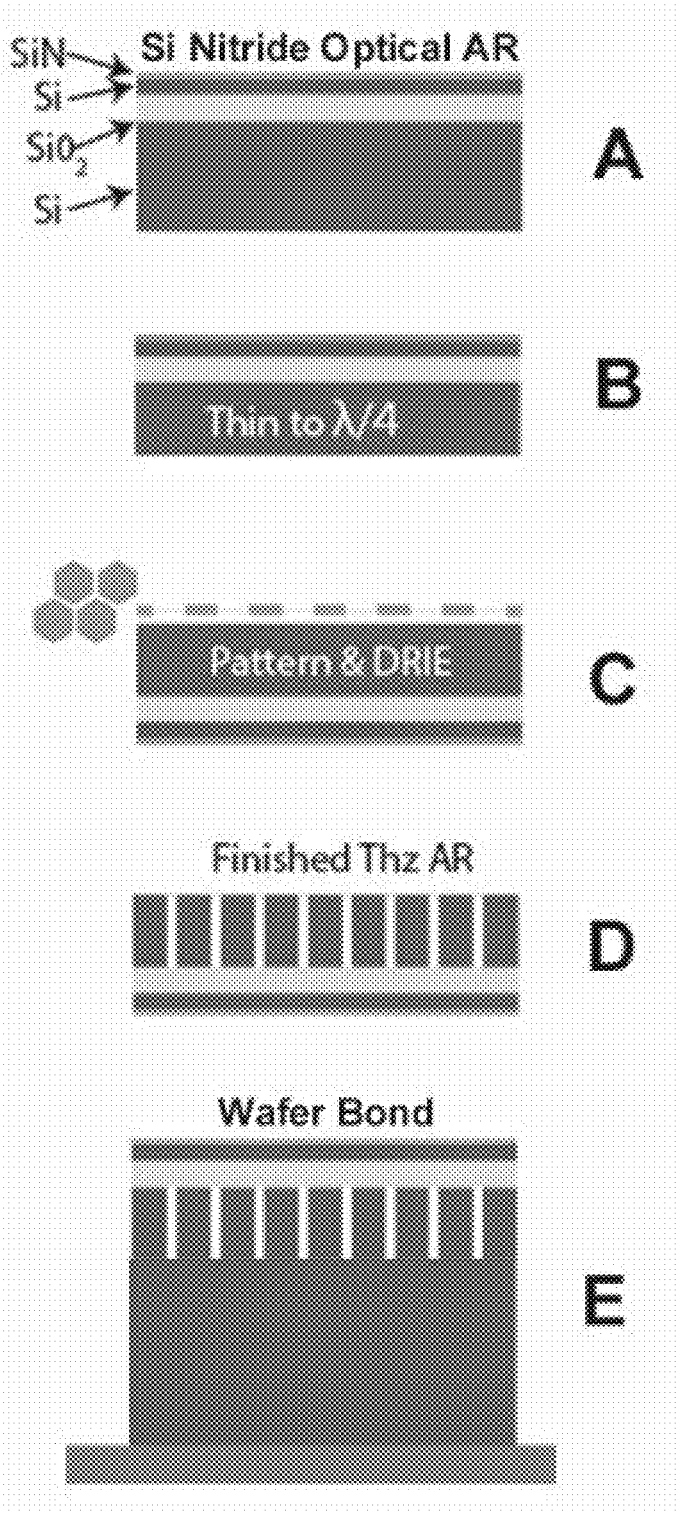
FIG. 19 illustrates details of an example fabrication process for a diffractive element.

FIG. 19 illustrates how the diffractive elements described herein may be manufactured using conventional semiconductor fabrication processes. The Silicon-on-Insulator wafer (A) is coated with a 43 nm SiNx passivation which serves as an AR coating for 405 nm light. In (B), the SOI handle wafer is thinned via CMP to THz quarter-wave thickness. In (C), a hexagonal pattern is masked, followed by deep-reactive ion etch (DRIE) to form the honeycomb (D). The structure is wafer-bonded to a bulk Si wafer (E) to give a net 180° THz phase shift upon reflection from the backplane.

In somewhat more detail, a SOI wafer is obtained with a top layer Si thickness of 200-300 nm, which will form the photoconductive active layer. A $SiO_2$ thickness of 200-500 nm will be used. This thickness is not critical as long as it is much thinner than the THz wavelength. The SOI handle wafer is thinned using chemical-mechanical polishing (CMP) to the required substrate thickness. In the prototype, this will be 430 um for 94 GHz. The thickness range of 580-58 um is compatible with CMP capabilities. A hexagonal pattern with a fill density of 35% will be etched on the back of the thinned Si handle wafer substrate via a Deep-Reactive-Ion-Etch (DRIE) process. The $SiO_2$ layer will serve as an etch stop. The size of the hexagons is not critical, as long as they are smaller than a wavelength for the $n_{eff}$ of the artificial dielectric. For $n_{eff}$=1.85, 94 GHz will have a 1.72 mm wavelength. It will be straightforward to construct hexagonal structures with pitch dimensions 1/10 of λ, e.g. 172 um in pitch, resulting in an aspect ratio of 2.5. The aspect ratio of the artificial dielectric scales with design frequency, such that at 700 GHz (λ=228 um @ n=1.85), the hexagon pitch is 23 um, and the feature height is 58 um. The completed SiN—Si—$SiO_2$-THzAR wafer structure will then be wafer bonded onto a Si wafer of the appropriate thickness to result in a net bidirectional phase shift of 180°, counting the THz AR layer delay. For silicon (n=3.42), this will be λ/2=467 um or an integer multiple. A metallic backplane will be deposited on the bottom of the second wafer.

Advanced Techniques for Carrier Lifetime Modulation and Intrinsic Photoconductive Gain:

Carrier lifetime control through the use of actively-tunable surface recombination provides simultaneous fast RF beam modulation rates and low laser excitation power. In thin layers of Si, recombination happens at a much higher rate than in bulk at the interface between materials due to surface defects. A tunable surface recombination technique may be possible, where the available carriers at the surface are modulated by electrostatic fields. By applying a bias voltage across the dynamically writeable RF reflection layer, the relative amount of holes and electrons can be controlled. When there is an equal population, recombination is very fast. By biasing the dynamically writeable RF reflection layer into inversion (depletion) or accumulation, either holes or electrons are high in concentration; however, the matching carrier is not. For example, high electron concentration and low hole concentration can be produced, resulting in lower recombination due to lack of carriers.

What is claimed is:

1. A phase modulator for radio-frequency (RF) electromagnetic waves at a first range of frequencies, the phase modulator comprising:

a) RF reflective regions at a plurality of physical levels, the physical levels being separated by one or more RF phase-delay layers; and b) one or more dynamically writable reflective regions at one or more physical levels, the dynamically writable reflective regions having pattern spatial definition finer than the wavelength of the electromagnetic waves at the first range of frequencies.

2. The apparatus of claim 1, wherein the dynamically writeable reflective regions are plasmas in one or more semiconductor layers.

3. The apparatus of claim 2, wherein the semiconductor layer has a thickness on the order of magnitude of the electromagnetic skin depth of the electromagnetic waves in the plasma.

4. The apparatus of claim 2, wherein the plasma is written with photons with energy greater than the semiconductor bandgap of a semiconductor layer.

5. The apparatus of claim 4, wherein the absorption depth in the semiconductor layer at the photonic wavelength is on the order of magnitude of the skin depth of the electromagnetic wave in the plasma.

6. The apparatus of claim 4, wherein the apparatus includes optical antireflective structures, so as to reduce surface reflections of the photons.

7. The apparatus of claim 1, wherein the dynamically writable reflective regions are dynamically erasable.

8. The apparatus of claim 7, wherein the dynamically writable reflective regions are erased through recombination and thermalization of the plasma.

9. The apparatus of claim 7, wherein the dynamically writable reflective regions are erased through voltage field biasing and removal at one or more electrodes.

10. The apparatus of claim 2, wherein the plasma is confined by one or more electrically-insulating structures.

11. The apparatus of claim 1, wherein the reflective regions are operably engaged.

12. The apparatus of claim 11, wherein the apparatus includes antireflective structures.

13. The apparatus of claim 11, wherein the apparatus includes thermally-conductive structures.

14. The apparatus of claim 2, wherein the semiconductor layer surface is passivated, so as to increase carrier lifetime.

15. The apparatus of claim 2, wherein the semiconductor layer surface is doped, so as to reduce carrier lifetime.

16. The apparatus of claim 4, further comprising a photon patterning system selected from a group consisting of: a digital micromirror device, a grating light valve device, an addressable laser array, an addressable light emitting diode array, and a liquid crystal device.

17. The apparatus of claim 1, wherein the modulator is bendable.

18. The apparatus of claim 1, wherein the pattern is selected from a group consisting of: patch resonators, ring resonators, split-ring resonators, U-shaped resonators, V-shaped resonators and rod resonators.

19. The apparatus of claim 1, wherein a portion of the reflective regions are metallic elements.

* * * * *